United States Patent [19]

Koller et al.

[11] Patent Number: 4,472,613

[45] Date of Patent: Sep. 18, 1984

[54] CONTACT ELEMENT ARRANGEMENT FOR AN ELECTRICAL SWITCHING DEVICE, ESPECIALLY FOR A CONTACTOR

[75] Inventors: Peter Koller, Unterentfelden; Hans Lüthy, Holziken; Purnendu Chaudhuri, Oberentfelden, all of Switzerland; Hilmar Klepp, Braunschweig, Fed. Rep. of Germany

[73] Assignee: Sprecher & Schuh AG, Bucherstrasse, Switzerland

[21] Appl. No.: 436,308

[22] Filed: Oct. 25, 1982

[30] Foreign Application Priority Data

Nov. 21, 1981 [EP] European Pat. Off. ..... 81109823

[51] Int. Cl.[3] ..... H01H 9/30

[52] U.S. Cl. ..... 200/144 R; 200/147 R

[58] Field of Search ..... 200/147 R, 147 A, 147 B, 200/144 R, 144 A, 10

[56] References Cited

U.S. PATENT DOCUMENTS 2,340,682 2/1944 Powell ..... 200/147 A

FOREIGN PATENT DOCUMENTS 1175776 8/1964 Fed. Rep. of Germany .
1202378 10/1965 Fed. Rep. of Germany .
1665849 4/1971 Fed. Rep. of Germany .
1527353 6/1971 Fed. Rep. of Germany .
1765999 11/1971 Fed. Rep. of Germany .
2161616 12/1973 Fed. Rep. of Germany .
2647888 11/1978 Fed. Rep. of Germany .
2916276 10/1980 Fed. Rep. of Germany .
2928557 1/1981 Fed. Rep. of Germany .

*Primary Examiner*—A. D. Pellinen
*Assistant Examiner*—Morris Ginsburg
*Attorney, Agent, or Firm*—Werner W. Kleeman

[57] ABSTRACT

At the underside of a substantially U-shaped support or carrier formed of steel there is affixed an intermediate element or part formed of an electrically conductive material, for instance copper or a copper alloy. This intermediate element carries at its bottom face or surface two contact supports or members formed of a suitable material, for instance AgCdO. At the ends or end faces of the U-shaped support there are attached arc conducting elements formed of a ferromagnetic material, for instance steel. The arc conducting elements protrude away from the base portion of the U-shaped support in the direction of the contact supports and extend laterally thereof up to the region of their contact surfaces. The arcs arising during contact opening directly transfer or shift from the contact surfaces to the arc conducting elements, without the arc base points migrating laterally from the contact supports to their connection locations. The contact supports or members as well as their connection locations are thus protected against destruction by the arcs.

12 Claims, 4 Drawing Figures

CONTACT ELEMENT ARRANGEMENT FOR AN ELECTRICAL SWITCHING DEVICE, ESPECIALLY FOR A CONTACTOR

CROSS REFERENCE TO RELATED APPLICATION

This application is related to our commonly assigned, copending U.S. application Ser. No. 06/436309, filed Oct. 25, 1982, entitled "Contact Element for an Electrical Switching Device, Especially for a Protective Device".

BACKGROUND OF THE INVENTION

The present invention relates to a new and improved construction of a contact element or contact element arrangement, preferably a contact bridge member, for an electrical switching device or switchgear.

Generally speaking, the contact element or contact element arrangement for an electrical switching device or switchgear as contemplated by the invention is of the type comprising a support or carrier which is provided at one side or face thereof with at least one contact support or member which is operatively associated with an arc conducting element connected with the support or carrier.

In German Patent Publication No. 2,647,888 there is disclosed in the art a contact bridge member containing a trough or vat-shaped support at which there is affixed an intermediate element or part formed of electrically conductive material. Soldered to such intermediate element are two contact supports. The intermediate element possesses end portions which extend away from the contact supports and bound at the ends of the support or carrier. These end portions serve as arc burn-off pieces or elements.

Apart from the fact that with this construction there is not afforded a rapid migration of the arc base points from the contact supports to the arc burn-off pieces, there additionally prevails the danger that the attachment locations of the contact supports with the intermediate element are attacked by the arcs commutating to the arc burn-off pieces. Consequently, there is appreciably reduced the service life of the contact bridge member.

Additionally, a construction of contact bridge member is known wherein the contact supports are directly applied to the base portion of a substantially U-shaped support or carrier and are electrically conductively interconnected by means of a web. Significant in this regard is German Patent Publication No. 1,175,776. At the ends of the support there are secured thereto arc conducting elements which protrude away from the base portion of the support in the direction of the contact supports. Since such arc conducting elements consist of steel the arc base points migrate more rapidly from the contact surfaces than in the case of the previously explained construction of contact bridge member. Nonetheless, even with this solution there is attacked the connection locations between the contact supports and the support or carrier by the arcs which migrate by means of their base points laterally along the contact supports towards the arc conducting elements or pieces. The thus caused damage, which is especially appreciable in the presence of high cut-off currents, necessitates exchange of the contact bridge member after a relatively short period of use.

Other known constructions of contact elements are exemplified by German Pat. No. 1,202,378, German Pat. No. 2,161,616, German Pat. No. 1,527,353 and German Patent Publication No. 2,928,557.

SUMMARY OF THE INVENTION

Therefore, with the foregoing in mind it is a primary object of the present invention to provide a new and improved construction of contact element or contact element arrangement for an electrical switching device which is not associated with the aforementioned drawbacks and limitations of the prior art constructions.

Another and more specific object of the present invention is directed to the provision of an improved contact element of the character described which is simple in its construction and relatively easy to fabricate, and furthermore, possesses a mass which is as low as possible and allows for high switching rates even in the presence of great cut-off currents.

Now in order to implement these and still further objects of the invention, which will become more readily apparent as the description proceeds, the contact element or contact element arrangement of the present development is manifested by the features that, the arc conducting element protrudes from the support or carrier in the direction of the related contact support or member and extends up to the region of the contact element.

The base point of an arc caused by contact opening travels directly from the contact element to the arc conducting element extending up to the region of suoh contact element and past the attachment or connection location thereof, without laterally migrating along the contact element. The connection or attachment location and also the contact element itself are therefore effectively protected by the arc conducting element against being attacked by the arc. The arc conducting element can be formed of a suitable material, preferably a ferromagnetic material, affording a rapid migration of the arc away from the contact element, and additionally, is resistant to burn-off and also possesses good arc travel properties. Even in the presence of relatively large cut-off currents the wear of the contact element is therefore slight, rendering possible a corresponding long service life thereof.

According to a preferred construction of the inventive contact element or contact element arrangement the same is constructed such that at one side or face of the support or carrier there are provided two contact supports or members which are electrically interconnected with one another by means of an intermediate element. As to these two contact supports each has operatively associated therewith an arc conducting element protruding from the support or carrier and extending up to the contact supports. With this preferred design of the inventive contact element arrangement as a contact bridge member it is possible, as is known, to fabricate the support or carrier of a material having a greater mechanical strength, so that the intermediate element essentially only has to provide a good electrically conductive connection between the contact supports or members. This enables attaining a contact element arrangement of as low mass as possible and which is capable of withstanding pronounced electrical and mechanical loads, both with the contacts open as well as also during the opening and closing of the contacts.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
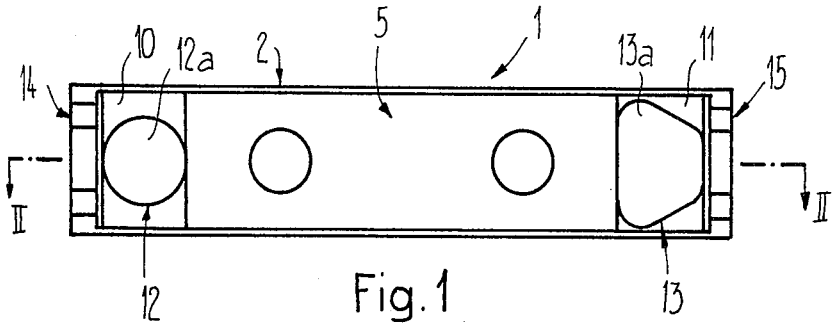
FIG. 1 is a front view of a contact bridge member for an electrical switching device or switchgear and constructed according to the invention.
Figure 2:
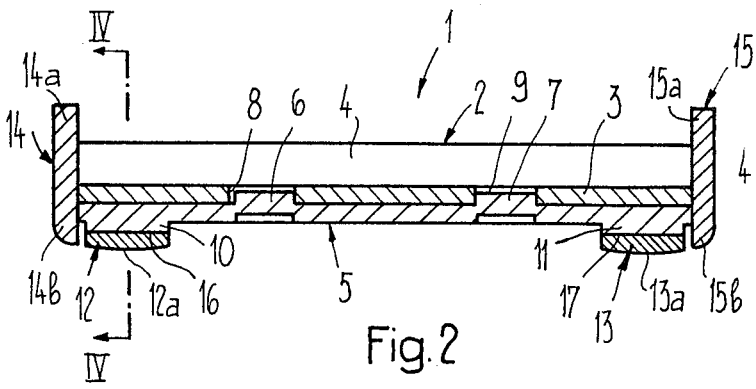
FIG. 2 is a sectional view of the arrangement of FIG. 1, taken substantially along the line II—II thereof.
Figure 3:
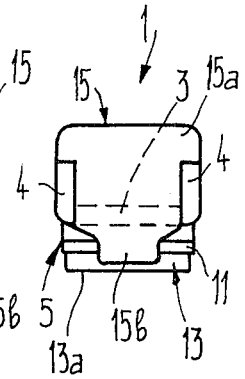
FIG. 3 is a side view of the contact bridge member.
Figure 4:
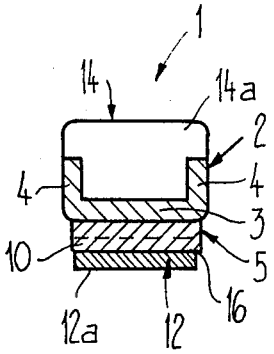
FIG. 4 is a sectional view of the arrangement of FIG. 2, taken substantially along the line IV—IV thereof.

Describing now the drawings, the contact bridge member 1 illustrated therein will be seen to comprise a substantially U-shaped support or carrier member 2 which, for instance, is formed of steel. The base portion of the support or carrier member 2 has been designated by reference numeral 3 and its flanges by reference numeral 4. At the underside or bottom face of the support or carrier member 2 there is attached at its base portion 3 an intermediate element 5, preferably by means of hard soldering or brazing. This intermediate element 5 consists of an electrically conductive material, preferably copper, and is provided at its side or face confronting the support member 2 with projections or protuberances 6 and 7, each of which engages into a related centering hole 8 and 9, respectively, provided in the base portion 3. By means of these centering holes or bores 8 and 9 the intermediate element 5 is positioned during its attachment at the support member 2.

At the side located opposite the projections or protuberances 6 and 7 the intermediate element 5 is provided at the region of its ends or end faces with raised portions 10 and 11, respectively upon which there are arranged the contact elements or members 12 and 13. These contact elements or members 12 and 13 are connected with the intermediate element 5 in any suitable fashion, for instance by hard soldering or brazing. The contact elements 12 and 13 consist of a suitable contact material, by way of example AgCdO.

The support member 2 imparts to the contact bridge member 1 good mechanical strength, whereas the intermediate element 5 essentially has assigned to it only the task of ensuring for a good electrically conductive connection between both of the contact elements or members 12 and 13. By providing a suitable construction and/or material selection it is therefore possible to obtain a contact bridge member 1 having a low mass and which is capable of withstanding pronounced electrical and mechanical loads.

At the ends of the support member 2 there are connected thereto substantially plate-shaped arc conducting elements or pieces 14 and 15, again for instance by means of hard soldering or brazing. These arc conducting elements 14 and 15 consist of a ferromagnetic material, for instance steel. The arc conducting elements 14 and 15, which extend essentially at right angles to the base portion 3 of the support member 2, protrude at both sides past such base portion 3. By means of their upper ends 14*a* and 15*a* these arc conducting elements 14 and 15, respectively, protrude past the upper edge of the flanges or flange members 4 of the support member 2. With their lower ends 14*b* and 15*b* the arc conducting elements 14 and 15, respectively, extend up to the contact elements or members 12 and 13, respectively, and extend laterally thereof up to the region of their contact surfaces 12*a* and 13*a*, respectively. Hence, the arc conducting elements 14 and 15 extend past the connection or attachment locations 16 and 17, respectively, located between the contact elements 12 and 13 and the intermediate element 5.

The arcs which are formed during contact opening initially burn at the contact surfaces 12*a* and 13*a* of the contact elements 12 and 13, respectively, and thereafter commutate to the arc conducting elements or pieces 14 and 15 neighbouring these contact elements 12 and 13. Since these arc conducting elements 14 and 15, as already explained, are composed of a ferromagnetic material, this transfer or shifting of the arc base points from the contact surfaces 12*a* and 13*a* to the arc conducting elements 14 and 15 is accomplished extremely rapidly, which, in turn, reduces to a minimum the burn-off of the contact elements or members 12 and 13. Since the arc conducting elements 14 and 15 possess a good burn-off resistance or strength, the arcs burning at such arc conducting elements 14 and 15, until they extinguish, do not cause any appreciable damage.

Since the arcs, as explained, directly travel or migrate from the contact surfaces 12*a* and 13*a* of the contact elements 12 and 13, respectively, to the related arc conducting elements 14 and 15, respectively, there is effectively prevented that the arc base points will laterally move along the contact elements to their connection or attachment locations 16 and 17, which would result in an undesired burn-off of the contact elements 12 and 13 as well as damage to these connection locations 16 and 17. The contact bridge member 1 therefore is protected from being rapidly worn, even in the presence of high cut-off currents by virtue of the construction of the arc conducting elements 14 and 15, and this has an advantageous affect upon the service life of the contact bridge member 1.

It should be understood that the contact bridge member can be differently constructed as to different parts thereof from the described arrangement. Thus, for instance, it is possible to impart to the contact elements or members 12 and 13 any desired configuration. In FIG. 1 there have been depicted, as concerns the contact elements 12 and 13, two possible variant constructions. Thus, at the left-hand side thereof the contact element 12 possesses in plan view a substantially circular configuration, whereas the other contact element 13 at the right-hand side of such FIG. 1 possesses a substantially trapezoidal shape. Moreover, it is also conceivable to angle or flex the lower ends 14*b* and 15*b* of the arc conducting elements 14 and 15, in the event this should be necessary, in order to place such ends at the neighborhood of the contact elements 12 and 13.

The described contact bridge member is particularly suitable, although not exclusively, for use with a protective device. A preferred construction of such switching protection device has been described, for instance, in our aforementioned commonly assigned, copending U.S. application Ser. No. 06/436,309, filed Oct. 25, 1983.

While there are shown and described present preferred embodiments of the invention, it is to be distinctly understood that the invention is not limited thereto, but may be otherwise variously embodied and practiced within the scope of the following claims. Accordingly,

What we claim is:

1. A contact element arrangement for an electrical switching device, especially for a contactor, comprising:

a support member;

at least one contact element provided at one side of the support member and connected with said support member at an attachment location;

said at least one contact element having a contact surface;

at least one arc conducting element formed of a ferromagnetic material and connected with said support member;

said at least one contact element being operatively associated with said at least one arc conducting element in order to conduct an arc away from said at least one contact element to said at least one arc conducting element; and said at least one arc conducting element extending in the direction of the at least one contact element away from the support member and laterally of the at least one contact element beyond the attachment location of the at least one contact element and up to the region of the at least one contact element.

2. The contact element arrangement as defined in claim 1, wherein:

two of said contact elements are provided at said one side of said support member;

an intermediate element electrically connecting said two contact elements with one another and attached to said support member;

a respective one of said arc conducting elements provided for each one of said two contact elements; and each of said arc conducting elements protruding from the support member and extending up to the region of its related contact element.

3. The contact element arrangement as defined in claim 2, wherein:

each said arc conducting element extends laterally of the related contact element up to the region of the contact surface thereof.

4. The contact element arrangement as defined in claim 1, wherein:

said at least one arc conducting element extends laterally of said at least one contact element up to the region of the contact surface thereof.

5. The contact element arrangement as defined in claim 1, wherein:

said at least one arc conducting element protrudes past the support member at oppositely situated sides thereof.

6. The contact element arrangement as defined in claim 2, wherein:

each said arc conducting element protrudes past the support member at oppositely situated sides thereof;

said support member comprising a substantially U-shaped support member containing a base portion; and the arc conducting elements being arranged at opposite ends of said U-shaped support member and protruding at both sides of said support member past said base portion thereof.

7. The contact element arrangement as defined in claim 2, wherein:

said contact elements are mounted at said intermediate element which is connected with said support member.

8. The contact element arrangement as defined in claim 7, wherein:

said intermediate element is formed of an electrically conductive material; and said support member being formed of a material having a greater mechanical strength than the electrically conductive material of the intermediate element.

9. The contact element arrangement as defined in claim 8, wherein:

said intermediate element possesses at least one projection;

said support member being provided with at least one centering hole; and said at least one projection engaging into said at least one centering hole.

10. The contact element arrangement as defined in claim 7, wherein:

said intermediate element possesses at least one projection;

said support member being provided with at least one centering hole; and said at least one projection engaging into said at least one centering hole.

11. A contact element arrangement for an electrical switching device, especially for a contactor, comprising:

a support member;

at least one contact element provided at one side of the support member and attached to said support member at an attachment location;

said at least one contact element having a contact surface;

at least one arc conducting element formed of a ferromagnetic material and connected with said support member;

said at least one contact element being operatively associated with said at least one arc conducting element in order to conduct an arc away from said contact surface of said at least one contact element to said at least one arc conducting element; and said at least one arc conducting element being connected to said support member so as to extend past the same at oppositely situated sides thereof and on one of such sides laterally of the at least one contact element beyond the attachment location and up to the region of the contact surface of such contact element.

12. A contact element arrangement for an electrical switching device, especially for a contactor, comprising:

a support member;

an intermediate element mounted at one side of said support member;

at least one contact element attached at said intermediate element at an attachment location;

said at least one contact element having a contact surface;

at least one arc conducting element formed of a ferromagnetic material and connected with said support member;

said at least one contact element being operatively associated with said at least one arc conducting element in order to conduct an arc away from the contact surface of said at least one contact element to said at least one arc conducting element; and said at least one arc conducting element being connected to said support member so as to extend past the same at oppositely situated sides thereof and on one of such sides laterally of the contact element beyond said attachment location at said intermediate element and up to the region of the contact surface of said at least one contact element.

* * * * *

UNITED STATES PATENT AND TRADEMARK OFFICE

CERTIFICATE OF CORRECTION

PATENT NO. : 4,472,613

DATED : September 18, 1984

INVENTOR(S) : Peter KOLLER et al

It is certified that error appears in the above—identified patent and that said Letters Patent is hereby corrected as shown below:

Column 2, line 26, after "contact" please delete "support" and insert --element--

Column 2, line 31, please delete "suoh" and insert --such--

Signed and Sealed this

*Nineteenth* Day of *February 1985*

[SEAL]

*Attest:*

DONALD J. QUIGG

*Attesting Officer*

*Acting Commissioner of Patents and Trademarks*